US007864965B2

(12) United States Patent
Beard

(10) Patent No.: US 7,864,965 B2
(45) **Date of Patent: *Jan. 4, 2011**

(54) MULTICHANNEL SPECTRAL MAPPING AUDIO APPARATUS AND METHOD

(75) Inventor: Terry D. Beard, 1407 N. View Dr. Westlake Village, Thousand Oaks, CA (US) 91362

(73) Assignee: Terry D. Beard, Westlake Village, CA (US)

( * ) Notice: Subject to any disclaimer, the term of this patent is extended or adjusted under 35 U.S.C. 154(b) by 492 days.

This patent is subject to a terminal disclaimer.

(21) Appl. No.: 11/745,969

(22) Filed: May 8, 2007

(65) Prior Publication Data

US 2007/0206801 A1 Sep. 6, 2007

Related U.S. Application Data

(63) Continuation of application No. 11/515,400, filed on Sep. 1, 2006, which is a continuation of application No. 09/891,941, filed on Jun. 25, 2001, now Pat. No. 7,164,769, which is a continuation of application No. 08/715,085, filed on Sep. 19, 1996, now Pat. No. 6,252,965.

(51) Int. Cl.
*H04R 5/00* (2006.01)
*G10L 19/00* (2006.01)

(52) U.S. Cl. ..... 381/22; 381/17; 381/18; 381/19; 381/20; 381/21; 381/23; 704/500; 704/E19.005

(58) Field of Classification Search ..... 381/1, 381/2, 17–23, 310; 704/500, E19.005, 203–205
See application file for complete search history.

(56) References Cited

U.S. PATENT DOCUMENTS 3,746,792 A 7/1973 Scheiber
3,959,590 A 5/1976 Scheiber (Continued)

FOREIGN PATENT DOCUMENTS

DE 4209544 9/1993

(Continued)

OTHER PUBLICATIONS

Dressler, "Dolby Pro Logic Surround Decoder Principles of Operation," http://www.dolby.com/htds&pl/whtppr.html, pp. 1-13.

(Continued)

*Primary Examiner*—Devona E Faulk
(74) *Attorney, Agent, or Firm*—Fish & Richardson P.C.

(57) ABSTRACT

A method and circuit for deriving a set of multichannel audio signals from a conventional monaural or stereo audio signal uses an auxiliary multichannel spectral mapping data stream. Audio can be played back in stereo and multichannel formats from a conventional stereo signal on compact discs, FM radio, or other stereo or monaural delivery systems. The invention reduces the data rate needed for the transmission of multichannel digital audio.

8 Claims, 6 Drawing Sheets

U.S. PATENT DOCUMENTS

| | | | | |
|---|---|---|---|---|
| 4,018,992 | A * | 4/1977 | Olson | 381/22 |
| 4,449,229 | A | 5/1984 | Mori | |
| 4,803,727 | A | 2/1989 | Holt et al. | |
| 4,815,132 | A | 3/1989 | Minami | |
| 5,136,650 | A | 8/1992 | Griesinger | |
| 5,228,093 | A | 7/1993 | Agnello | |
| 5,274,740 | A | 12/1993 | Davis et al. | |
| 5,285,498 | A | 2/1994 | Johnston | |
| 5,319,713 | A | 6/1994 | Waller et al. | |
| 5,333,201 | A | 7/1994 | Waller et al. | |
| 5,381,482 | A | 1/1995 | Matsumoto et al. | |
| 5,459,790 | A | 10/1995 | Scofield et al. | |
| 5,471,411 | A | 11/1995 | Adams et al. | |
| 5,524,054 | A | 6/1996 | Spille | |
| 5,579,124 | A | 11/1996 | Aijala et al. | |
| 5,632,005 | A | 5/1997 | Davis et al. | |
| 5,638,451 | A | 6/1997 | Sedlmeyer | |
| 5,671,287 | A * | 9/1997 | Gerzon | 381/17 |
| 5,930,733 | A | 7/1999 | Park et al. | |
| 6,252,965 | B1 * | 6/2001 | Beard | 381/23 |
| 2007/0206803 | A1 | 9/2007 | Beard | |
| 2007/0206821 | A1 | 9/2007 | Beard | |

FOREIGN PATENT DOCUMENTS

| | | |
|---|---|---|
| EP | 0 259 553 | 3/1988 |
| EP | 0540329 | 5/1993 |
| EP | 0730365 | 9/1996 |
| JP | 04-079599 | 3/1992 |
| JP | 04-225700 | 8/1992 |

OTHER PUBLICATIONS

Waller, Jr., "The Circle of Surround Audio Surround Audio Surround System," Rocktron Corporation White Pager, pp. 1-7.

O'Shaughnessy, "Speech Communication—Human and Machine," Addison-Wesley Publishing Company, 1987, pp. 148-153.

Joseph Rothstein, "Digidesigns Pro Tools Hardware and Software" OPI 13, Sep. 1996.

European Office Action for Application No. EP 97942684.8 dated Sep. 10, 2009, 3 pages.

USPTO Non-Final Office Action in U.S. Appl. No. 11/745,952 mailed Sep. 24, 2009, 18 pages.

USPTO Non-Final Office Action in U.S. Appl. No. 11/745,991, mailed Sep. 25, 2009, 22 pages.

USPTO Non-Final Office Action in U.S. Appl. No. 11/745,992, mailed Sep. 30, 2009, 15 pages.

European Office Action for Application No. EP 07018827.1, dated Mar. 4, 2010, 5 pages.

* cited by examiner

MULTICHANNEL SPECTRAL MAPPING AUDIO APPARATUS AND METHOD

RELATED APPLICATIONS

The present application is a continuation of U.S. patent application Ser. No. 11/515,400 filed on Sep. 1, 2006, which is a continuation of U.S. patent application Ser. No. 09/891,941 filed on Jun. 25, 2001, now U.S. Pat. No. 7,164,769, which is a continuation of U.S. patent application Ser. No. 08/715,085 filed on Sep. 19, 1996, now U.S. Pat. No. 6,252,965. Each of these applications is hereby incorporated by reference in its entirety.

BACKGROUND OF THE INVENTION

1. Field of the Invention

This invention relates to multichannel audio systems and methods, and more particularly to an apparatus and method for deriving multichannel audio signals from a monaural or stereo audio signal.

2. Description of the Related Art

Monaural sound was the original audio recording and playback method invented by Edison in 1877. This method was subsequently replaced by stereo or two channel recording and playback, which has become the standard audio presentation format. Stereo provided a broader canvas on which to paint an audio experience. Now it has been recognized that audio presentation in more than two channels can provide an even broader canvas for painting audio experiences. The exploitation of multichannel presentation has taken two routes. The most direct and obvious has been to simply provide more record and playback channels directly; the other has been to provide various matrix methods which create multiple channels, usually from a stereo (two channel) recording. The first method requires more recording channels and hence bandwidth or storage capacity. This is generally not available because of intrinsic bandwidth or data rate limitations of existing distribution means. For digital audio representations, data compression methods can reduce the amount of data required to represent audio signals and hence make it more practical, but these methods are incompatible with normal stereo presentation and current hardware and software formats.

Matrix methods are described in Dressler, "Dolby Pro Logic Surround Decoder—Principles of Operation" (http:-//www.dolby.com/ht/ds&pl/whtppr.-html); Waller, Jr., "The Circle Surround® Audio Surround Systems", Rocktron Corp. White Paper; and in U.S. Pat. Nos. 3,746,792, 3,959,590, 5,319,713 and 5,333,201. While matrix methods are reasonably compatible with existing stereo hardware and software, they compromise the performance of the stereo or multichannel presentations, or both, their multichannel performance is severely limited compared to a true discrete multichannel presentation, and the matrixing is generally uncontrolled.

SUMMARY OF THE INVENTION

The present invention addresses these shortcomings with a method and apparatus which provide an uncompromised stereo presentation as well as a controlled multichannel presentation in a single compatible signal. The invention can be used to provide a multichannel presentation from a monaural recording, and includes a spectral mapping technique that reduces the data rates needed for multichannel audio recording and transmission.

These advantages are achieved by sending along with a normally presented "carrier" audio signal, such as a normal stereo signal, a spectral mapping data stream. The data stream comprises time varying coefficients which direct the spectral components of the "carrier" audio signal or signals to multichannel outputs.

During multichannel playback, the invention preferably first decomposes the input audio signal into a set of spectral band components. The spectral decomposition may be the format in which the signals are actually recorded or transmitted for some digital audio compression methods and for systems designed specifically to utilize this invention. An additional separate data stream is sent along with the audio data, consisting of a set of coefficients which are used to direct energy from each spectral band of the input signal or signals to the corresponding spectral bands of each of the output channels. The data stream is carried in the lower order bits of the digital input audio signal, which has enough bits that the use of lower order bits for the data stream does not noticeably affect the audio quality. The time varying coefficients are independent of the input audio signal, since they are defined in the encoding process. The "carrier" signal is thus substantially unaffected by the process, yet the multichannel distribution of the signal is under the complete control of the encoder via the spectral mapping data stream. The coefficients can be represented by vectors whose amplitudes and orientations define the allocation of the input audio signal among the multiple output channels.

DETAILED DESCRIPTION OF THE INVENTION

Figure 1:
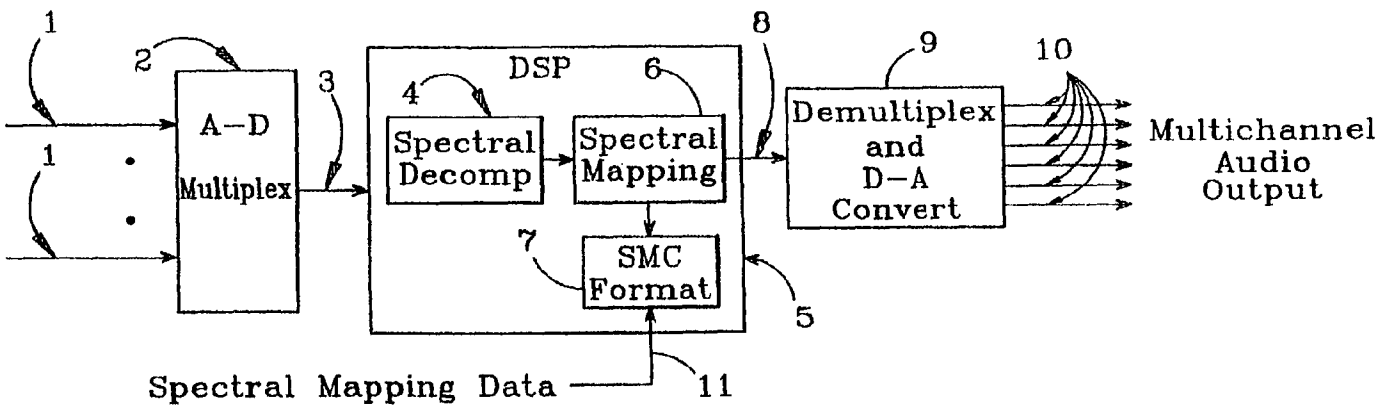
FIG. 1 is a block diagram of a digital signal processor (DSP) implementation of the invention's multichannel spectral mapping (MSM) decoder.

A simplified functional block diagram of a DSP implementation of a decoder that can be used by the invention is shown in FIG. 1. A "carrier" audio signal, which may be monaural or stereo for example, is input to an analog-to-digital (A-D) converter and multiplexer 2 via input lines 1. For simplicity singular term "signal" is used to include a composite of multiple input signals. In some applications the audio signal will already be in a multiplexed digital (PCM) representation and the A-D multiplexer will not be needed. The digital output of the A-D multiplexer is passed via line 3 to the DSP 5, where the signal is broken into a set of spectral bands in the spectral decomposition algorithm 4, and sent to a spectral mapping function algorithm 6. The spectral bands are preferably the conventional critical (bark) bands, which have a roughly constant bandwidth of about 100 Hz for frequencies below 500 Hz, and a bandwidth that increases with frequency for higher frequencies (roughly logarithmically above 1 kHz). Critical bands are discussed in O'Shaughnessy, Speech Communication—Human and Machine, Addison-Wesley, 1987, pages 148-153.

The spectral mapping function algorithm 6 directs the input signals in each of the bands from each of the input channels to corresponding bands of each of the output channels as directed by spectral mapping coefficients (SMCs) delivered from a spectral mapping coefficient formatter 7. The SMC data is input to the DSP 5 via a separate input 11. The multiplexed resultant digital audio output signals are passed over a line 8 to a demultiplexer digital-to-analog (D-A) converter 9, where they are converted into multichannel analog audio outputs applied to output lines 10, one for each channel.

The input signals can be broken into spectral bands in the spectral decomposition algorithm by any of a number of well know methods. One method is by a simple discrete Fourier transform. Efficient algorithms for performing the discrete Fourier transform are well known, and the decomposition is in a form readily useable for this invention. However, other common spectral decomposition methods such as multiband digital filter banks may also be used. In the case of the discrete Fourier transform decomposition, some transform components may be grouped together and controlled by a single SMC so that the number of spectral bands utilized by the invention need not equal the number of components in the discrete Fourier transform representation or other base spectral representation.

Figure 2:
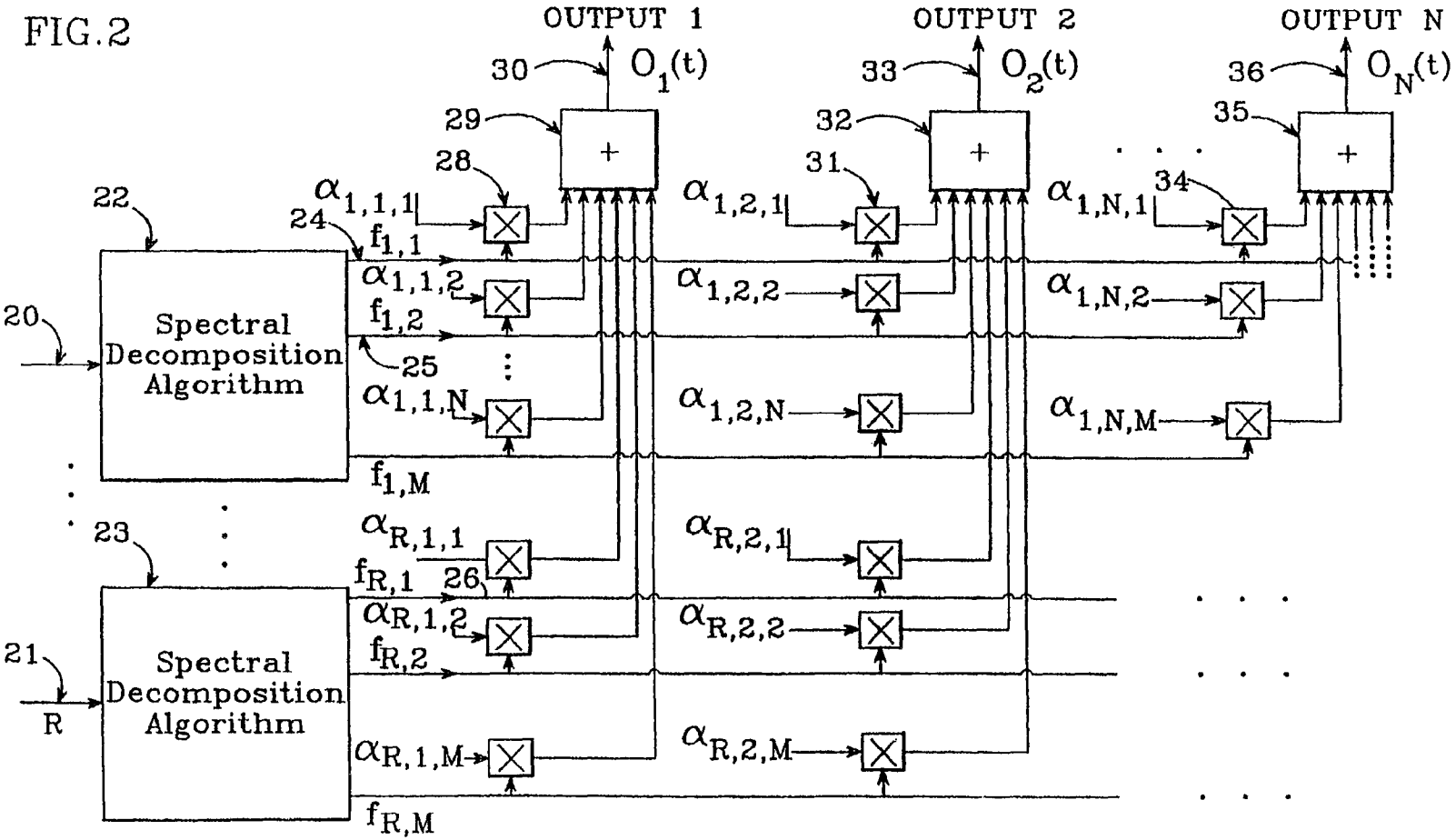
FIG. 2 is a block diagram illustrating the DSP multichannel spectral mapping algorithm structure.

A more detailed block diagram of the DSP multichannel spectral mapping algorithm 6, along with the spectral decomposition algorithm 4, is shown in FIG. 2. The signal "lines" in the drawing indicate information paths in the implementing DSP algorithm, while the multiply and sum function blocks indicate operations in the DSP algorithm that implement the spectral mapping aspect of the invention. This functional block diagram is shown only to describe the DSP implementation algorithm. Although the invention could in principle be implemented with separate multiply and add components as indicated in the drawing, that is not the intent implied by this explanatory figure.

Respective spectral decomposition algorithms 22 and 23 are provided for each input channel. For a standard stereo input consisting of left and right input signals respectively on input lines 20 and 21, left and right algorithms are provided; there is only one algorithm for a monaural input. Each spectral decomposition algorithm produces inputs to the spectral mapping algorithm within M spectral bands on corresponding lines 24, 25 . . . for algorithm 22, and lines 26 . . . for algorithm 23. The algorithms preferably operate on a multiplexed basis in synchronism with the multiplexed output of multiplexer 2 in FIG. 1, but are shown in FIG. 2 as separate blocks for ease of understanding.

The input frequency bands produced by the spectral decomposition algorithms are designated by the letter F followed by two subscripts, with the first subscript standing for the input channel and the second subscript for the frequency band within that channel. A separate SMC, designated by the letter $\alpha$, is provided for each frequency band of each input channel for mapping onto each output channel, with the first subscript after $\alpha$ indicating the corresponding input source channel, the second subscript the output target channel, and the third subscript the frequency band. The input frequency band F1,1 on line 24 is multiplied in multiplier 28 by a SMC $\alpha_{1,1,1}$ from the spectral mapping coefficient formatting algorithm 7 of FIG. 1, and passed to a summer 29 for the first output channel, where it is accumulated with the products of all the other input frequency bands multiplied by their respective SMCs for the first output channel. Specifically, the other input components F1,2 . . . F1,M . . . FR,1 FR,2 . . . FR,M (for R input channels) are multiplied by their respective SMCs $\alpha_{1,1,2} \ldots \alpha_{1,1,M} \ldots \alpha_{R,1,1}, \alpha_{R,1,2} \ldots \alpha_{R,1,M}$, to produce a first channel output 30. This process is duplicated for all spectral bands of all input and output channels as indicated in the figure, in which the multipliers, summer and output for output channel 2 are respectively indicated by reference numbers 31, 32 and 33, and the multipliers, summer and output for output channel N are respectively indicated by 34, 35 and 36.

From FIG. 2 the multichannel output signals are given by the following equations:

$$O_K(t) = \sum_T \sum_{J=1}^{R} \sum_{L=1}^{M} \alpha_{J,K,L,T} \times F_{J,L,T}(t)$$

where: $O_K(t)$=the output of channel K at time t.

$\alpha_{J,K,L,T}$=the SMC of input channel J's Lth spectral band component in time aperture period T onto output channel K.

$F_{J,L,T}(t)$=The Jth input channel's Lth spectral band signal at time t from aperture window T.

There are R input channels, M spectral bands in the decomposition of each input signal and N output channels. In the example given, at any particular time t there will be contributions to the output signal from components from one or two overlapping transform windows. T is the subscript indicating a particular transform window. The multiply and add operations described in the invention can be carried out on one of more DSPs, such as a Motorola 56000 series DSP.

In some applications, particularly those in which the input digital audio signal has been digitally compressed, the signal may be delivered to the playback system in a spectrally decomposed form and can be applied directly to the spectral mapping subsystem of the invention with simple grouping into appropriate bands. A good spectral decomposition is one that matches the spectral masking properties of the human hearing system like the so called "critical band" or "bark" band decomposition. The duration of the weighing function, and hence the update rate of the SMCs, should accommodate the temporal masking behavior of human hearing. A standard 24 "critical band" decomposition with 5-20 millisecond SMC update is very effective in the present invention. Fewer bands and a slower SMC update rate is still very effective when lower rates of spectral mapping data are required. Update rates can be as slow as 0.1 to 0.2 seconds, or even constant SCMs can be used.

Figure 3:
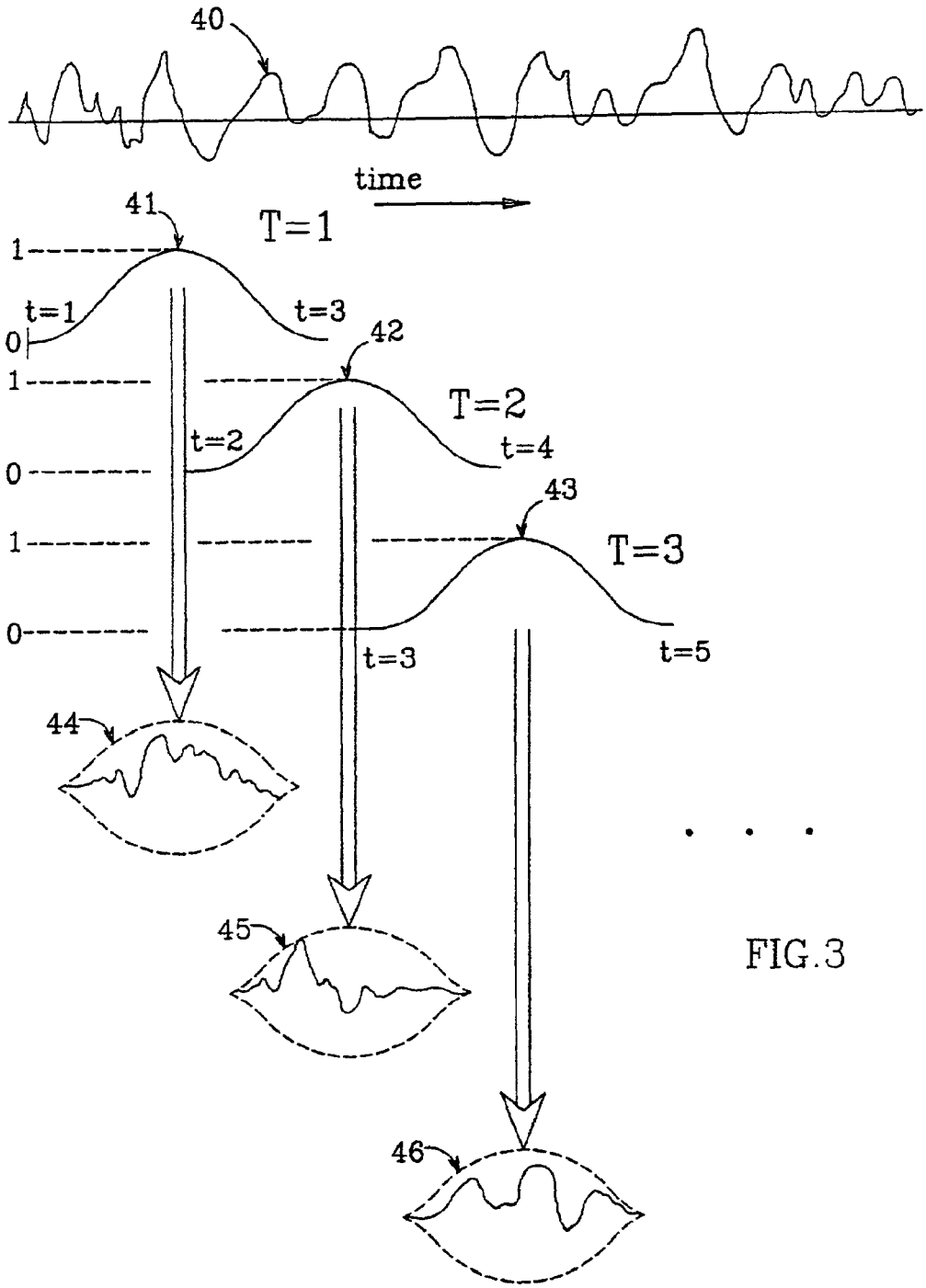
FIG. 3 is a set of signal waveforms illustrating the use of aperture functions to obtain discrete transform representations of continuous signals.

FIG. 3 illustrates the role of temporal aperture functions in the spectral decomposition of an audio signal and the relationship of the decomposition to the SMCs illustrated in FIGS. 1 and 2. An audio signal 40 is multiplied by generally bell curve shaped aperture functions 41, 42, 43 . . . to produce the bounded signal packets 44, 45, 46 . . . before performing the discrete Fourier transform on the resultant "apertured" packets. The aperture function 41 increases from zero at a time t=1 to unity and then back to zero over a period T that ends at time t=3. Aperture functions 42 and 43 have similar shapes, with function 42 spanning a second period T between t=2 and t=4, and function 43 spanning a third period T between t=3 and t=5. Each successive aperture function preferably begins at the midpoint of the immediately preceding aperture period. This process provides for artifact free recomposition of the signal from the resultant multiple transform representation and provides a natural time frame for the SMCs. Aperturing is the standard signal processing technique used in the discrete spectral transformation of continuous signals.

A set of SMCs can be provided for each transformed signal packet such as 44. These coefficients describe how much of each spectral component in the signal packet is directed to each of the output signal channels for that aperture period. In FIG. 2 the input signal is shown decomposed into frequency bands F1, F2, . . . , FM. The SMC is the fraction of the signal level in band L directed from the input J to output K for aperture period T. A complete set of coefficients define the distribution of the signals in all the spectral bands in a given T aperture period. A new set of SMCs are provided for the next overlapping aperture period, and so on. The total signal at any point in time on a given output channel will thus be the sum of the SMCs directing signal components from the overlapping spectral decompositions periods of the input "carrier" signal or signals.

The signal level in each frequency band ultimately represents the signal energy in that band. The energy level can be expressed in several different ways. The energy level can be used directly, or the signal amplitude of the Fourier transform can be used, with or without the phase component (energy is proportional to the square of the transform amplitude). The sine or cosine of the transform could also be used, but this is not preferred because of the possibility of dividing by zero when the transform is non-zero.

The frequency bands of the spectral decomposition of the signal are best selected to be compatible with the spectral and temporal masking characteristics of human hearing, as mentioned above. This can be achieved by appropriate grouping of discrete Fourier spectral components in "critical band"-like groups and using a single SMC control of all components grouped in a single band. Alternatively, conventional multiband digital filters may be used to perform the same function. The temporal resolution or update rate of the SMCs is ultimately limited to multiples of the time between the transform aperture functions illustrated in FIG. 3. For example, if the interval between time 1 and time 3 comprises 1000 PCM samples, providing a 1000 point discrete Fourier transform, the minimum time between updates of SMCs would be one-half that period or 500 PCM samples. In the case of a conventional digital audio sample rare of 48,000 samples per second, this is a period of 10.4 milliseconds.

Figure 4:
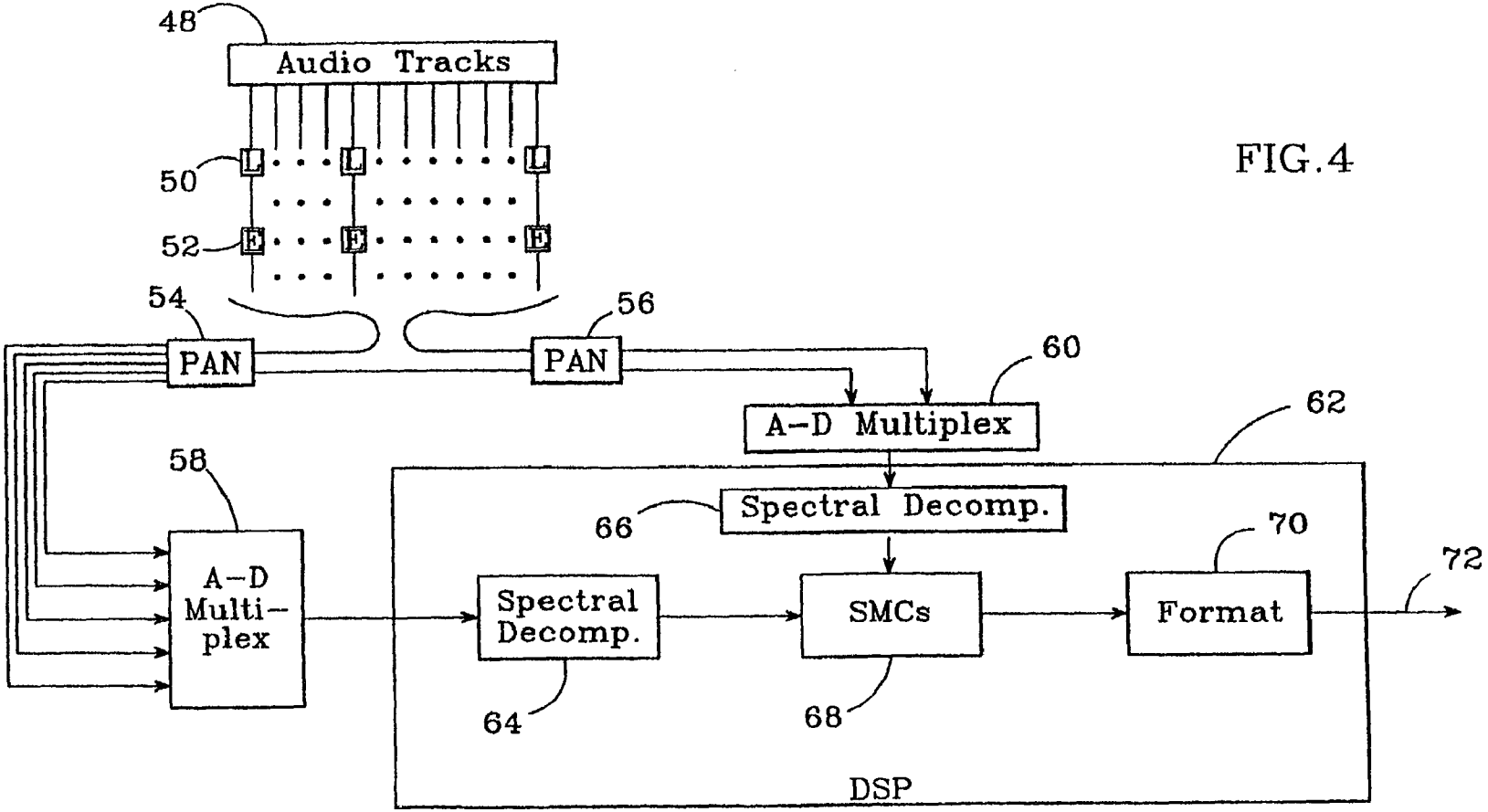
FIG. 4 is a block diagram of a DSP implementation of a method for calculating the spectral mapping coefficients in the encoding process.

One method for generating the SMCs in the encoding process is shown in the DSP algorithm functional block diagram of FIG. 4. Once generated, the SMCs are carried along with the standard stereo (or monaural) digital audio signal in the desired medium, such as a compact disk, tape or radio broadcast, formatted by the SMC formatting algorithm 6 at the player or receiver, and used to control the mapping of the original stereo or monaural signal onto the multitrack output from the decoder DSP 6.

An important feature of the invention relates to how the SMCs are generated in a conventional sound mixing process. One implementation proceeds as follows. Given the same master source material used to produce the basic stereo or mono "carrier" recording, which is usually a multitrack source 48 of 24 or more tracks, one produces a second "guide" mix in the desired multichannel output format. Separate level adjustors 50 and equalizers 52 are provided for each track. During the multichannel "guide" mix, the level and equalization of the master source tracks are maintained the same as in the stereo mix, but are panned or "positioned" to produce the desired multichannel mix using a multichannel panner 54 which directs different amounts of the source tracks to different "guide" or target channels (five guide channels are illustrated in FIG. 4). A separate panner 56 distributes the level adjusted and equalized track signals among the "carrier" or input source channels (stereo carrier channels are illustrated in FIG. 4).

The SMCs are derived by spectrally decomposing both the stereo carrier signals and the multichannel guide signals, and calculating the ratios of the signals in each output channel's spectral bands compared to the signal in the corresponding input "carrier" spectral bands. This procedure assures that the spectral makeup of the output channels corresponds to that of the "guide" multichannel mix. The calculated ratios are the SMCs required to attain this desired result. The SMC derivation algorithm can be implemented on a standard DSP platform.

The "guide" multichannel mix is delivered from panner 54 to an A-D multiplexer 58, and acts as a guide for determining the SMCs in the encoding process. The encoder determines the SMCs that will match the spectral content of the decoder's multichannel output to the spectral content of the multichannel "guide" mix. The "carrier" audio signal is input from panner 56 to an A-D multiplexer 60. The digital outputs from A-D multiplexers 58 and 60 are input to a DSP 62. Rather than the two A-D multiplexers shown for functional illustration, a single A-D multiplexer is generally used to convert and multiplex all "carrier" and "guide" signals into a single data stream to the DSP. The "carrier" and "guide" functions are shown separately in the figure for clarity of explanation.

The "guide" and "carrier" digital audio signals are broken into the same spectral bands as described above for the decoder by respective spectral decomposition algorithms 64 and 66. The level of the signal in each band of each input multichannel "guide" signal is divided by the level of each of the signals in the corresponding band of the "carrier" signal by a spectral band level ratio algorithm 68 to determine the value of the corresponding SMC. For example, the ratio of the signal level in band 6 of target channel 3 to the signal level of band 6 of carrier input channel 2 is SMC 2, 3, 6. Thus, if there are five channels in the "guide" multichannel mix and two channels (stereo) in the "carrier" mix, and the signals are each broken into ten spectral bands, a total of 100 SMCs would be calculated for each transform or aperture period. The calculated coefficients are formatted by an SMC formatter 70 and output on line 72 as the spectral mapping data stream used by the decoder.

The SMCs generated using the above method may be used directly in implementing the invention or they may be modified using various software authoring tools, in which case they can serve as a starting or first approximation of the final SMC data.

Alternatively, entirely new sets of coefficients may be produced to effect any desired multichannel distribution of the "carrier" signal. For example, any input signal can be directed to any output channel by simply setting all SMCs for that input to that output to 1 and all SMCs for that input to other channels to 0. Another feature which the SMCs may have is an added time or phase delay component to provide an added dimension of control in the multichannel output configuration derived from the "carrier" signal.

Conventional stereo matrix encoding can also be used in conjunction with the current invention to enhance the multichannel presentation obtained using the method. To do this the phases of the spectral band audio components of the "carrier" audio can be manipulated in the recording process to increase the separation and discreetness of the final multichannel output. In some cases this can reduce the amount of SMC data required to attain a given level of performance.

The coefficients in the SMC matrix need not be updated for every new transform period, and some of the coefficients may be set to always be 0. For example, the system may arbitrarily not allow signal from a left stereo input to appear on the right multichannel output, or the required rate of change of the low frequency band SMCs may not need to be as high as the rate for the upper frequency bands. Such restrictions can be used to reduce the amount of information required to be transmitted in the SMC data stream. In addition, other conventional data reduction methods may also be used to reduce the amount of data needed to represent the SMC data.

Figure 5:
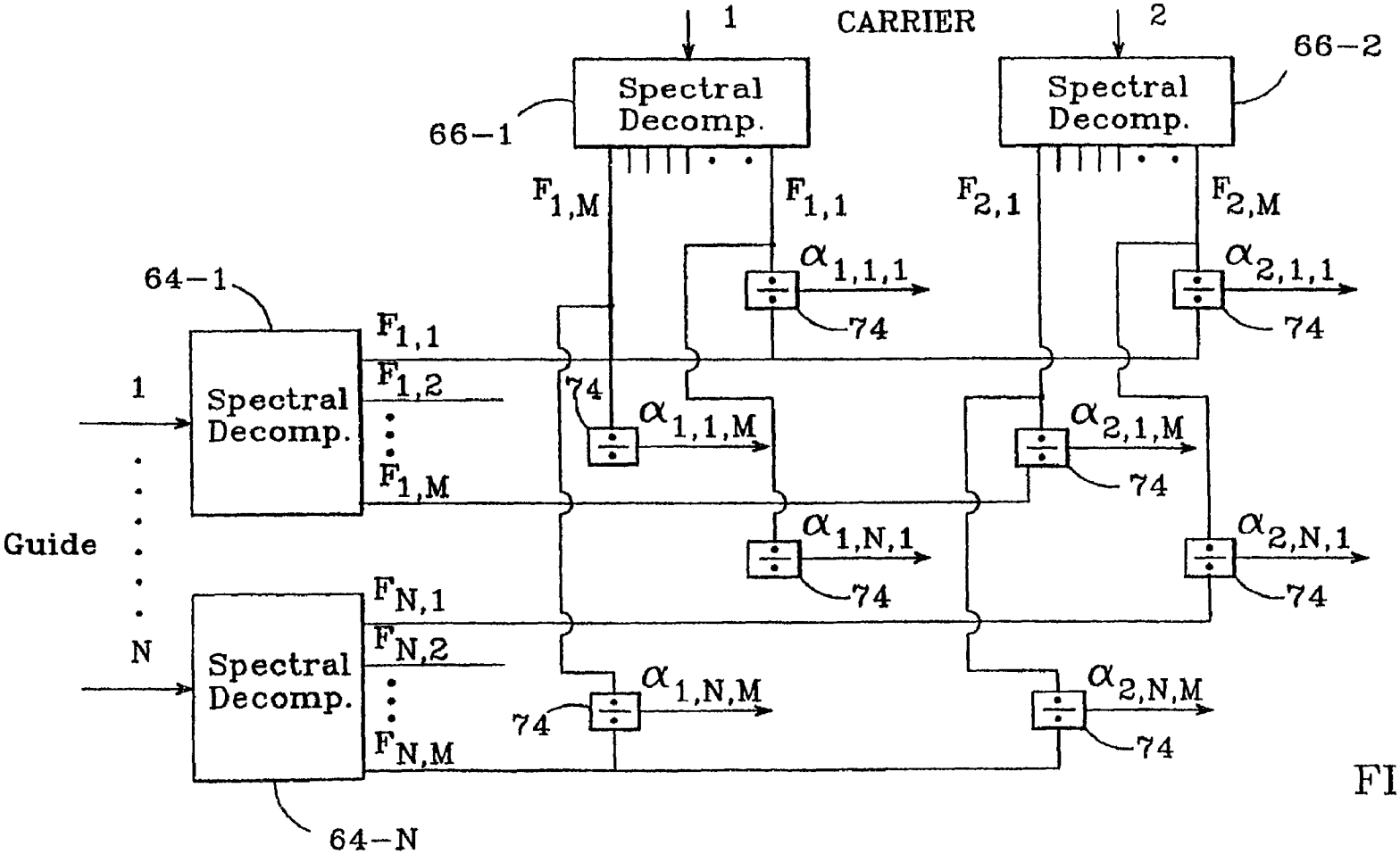
FIG. 5 is a block diagram illustrating the spectral mapping coefficient generating algorithm.

FIG. 5 illustrates in more detail the operation of encoder DSP 62 for the case of stereo input channels. As with the decoder algorithms, functions that are preferably performed by single algorithms on a multiplexed basis are illustrated as equivalent separate functions for ease of understanding. The input audio signal on the input stereo channels are spectrally decomposed by spectral decomposition algorithms 66-1 and 66-2 into respective frequency bands $F_{1,1} \ldots F_{1,M}$ and $F_{2,1} \ldots F_{2,M}$, while the guide signals on the desired N number of output channels are spectrally decomposed by spectral decomposition algorithms 64-1 through 64-N into respective frequency bands $F_{1,1} \ldots F_{1,M}$ through $F_{N,1} \ldots F_{N,M}$ that correspond to the input channel frequency bands. A set of dividers 74 (equal in number to 2×N×M) compare the signal level within each band of each input channel with the signal level within the corresponding bands of each of the output channels, by ratioing the two signal levels, to generate a set of SMCs that represent the ratios of the band-based output-to-input signal levels. Separate SMCs are obtained from each divider, and used at the decode end to map the input signals onto the output channels as described above.

Another important technique to reduce the amount of data required to be transmitted for the SMCs and to generalize the representation in a way that allows playback in a number of different formats is to not send the actual SMCs, but rather spectral component lookup address data from which the coefficients may be readily derived. In the case of the playback speakers arranged in three dimensions around the listener, only a 3-dimensional address of a given spectral component needs to be specified; this requires only three numbers. In the case of playback speakers arranged in a plane around the listener, only a 2-dimensional address of a given spectral component needs to be specified; this requires only two numbers. The translation of a 2 or 3-dimensional address into the SMCs for more or even fewer channels can be easily accomplished using a simple table lookup procedure. A conventional lookup table can be employed, or less desirably an algorithm could be entered for each different set of address data to generate the desired SMCs. For purposes of the invention an algorithm of this type is considered a form of lookup table, since it generates a unique set of coefficients for each different set of input address data.

Different addressable points in the address space would have different associated entries in the lookup table, or the SMCs may be generated by simple linear interpolation from the nearest entries in the table to conserve on table size. Formatting of the SMCs as sets of address numbers would be accomplished in the SMC formatter 64 of FIG. 4, while the lookup table at the decoder end would be embedded in the SMC formatter 6 of FIG. 1.

Figure 6:
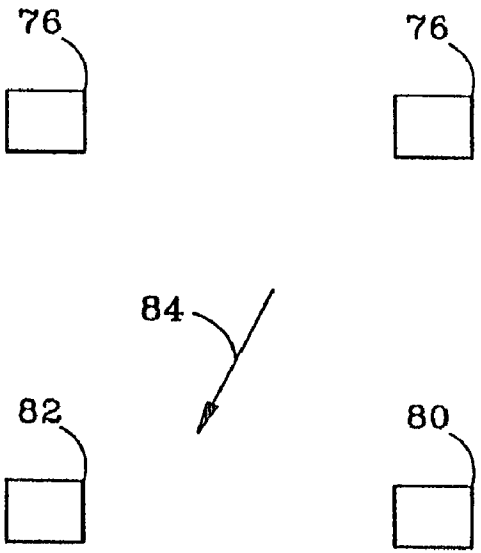
FIG. 6 is a block diagram illustrating a vector technique for representing the mapping coefficients.

The concept is illustrated in FIG. 6, in which four speakers 76, 78, 80 and 82 are all arranged in a common plane. A central vector arrow 84, which is shown pointing to a location between speakers 80 and 82 but closer to speaker 82, indicates the emphasis to be given to each of the speakers for a particular aperture time period and frequency band. Vector 84 is slightly greater than normal to a line from speaker 76, and generally points away from speaker 78. Thus, the SMCs for the decoder output for speaker 82 will be greater than for the other speakers, followed by progressively reduced SMC values for speakers 8, 76 and 78, in that order. If during the next aperture time period the output from speaker 76 is to be emphasized over the other speakers for the same frequency band, vector 84 will "point" toward speaker 76 and the SMCs for each of the speakers are adjusted accordingly, with the highest value SMCs for the band now assigned to speaker 76.

Taking the vector analogy a step further, the absolute amount of emphasis to be given to each speaker, as opposed to simply the desired direction of the emphasis, can also be given by vector 84. For example, the vector direction or orientation could be chosen to indicate the sound direction, and the vector amplitude the desired level of emphasis.

Figure 7:
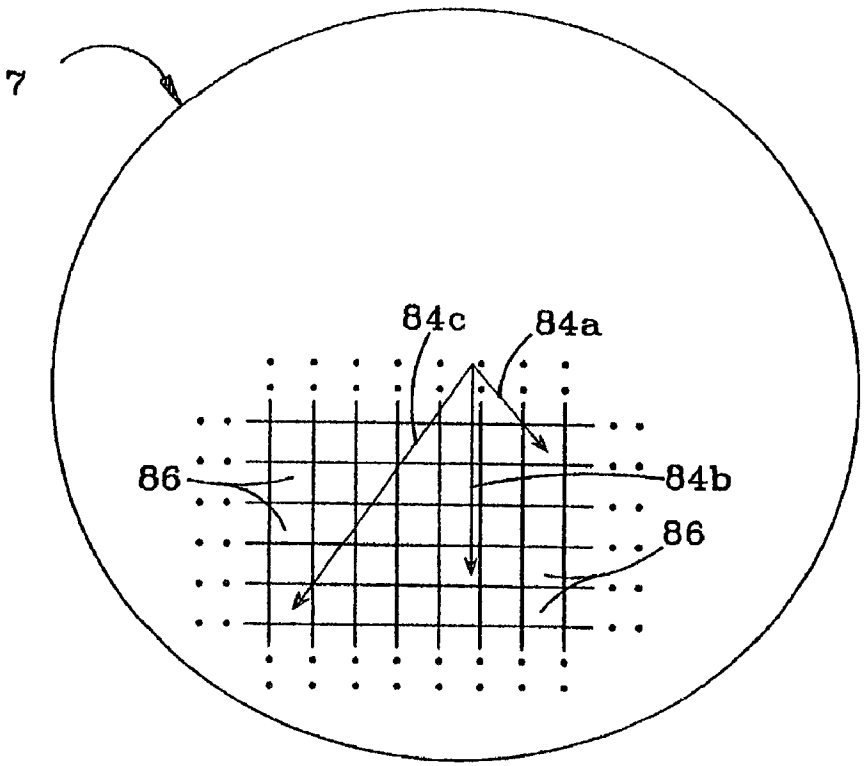
FIG. 7 is a diagram illustrating the use of the vector technique with decoder lookup tables.

FIG. 7 illustrates a mapping of different vectors 84*a*, 84*b*, 84*c* onto different lookup table addresses 86 that would be stored in the SMC formatting algorithm 7 of FIG. 1. Each address 86 stores a unique combination of SMCs. A complementary set of lookup table addresses is implemented in the encoder formatting algorithm 70 of FIG. 4 to generate the vectors from the originally calculated SMCs; these SMCs are restored from the vectors by lookup table addresses 86. Each address stores a set of coefficients that are equal in number to the number of input channels multiplied by the number of output channels. For example, with a stereo input and a five-channel output, each address would store ten SMCs, one for each input-output channel combination. Alternately, a separate lookup table could be provided for each stereo input channel, in which case each address would need to store only five SMCs. A separate vector is employed for each different frequency band, and the SMCs for a given output channel accumulated over all bands.

Since the particular address 86 used at any given time depends on both the vector amplitude and angle, it is not necessary that the vector amplitude correspond strictly to the degree of emphasis and the vector angle to the direction of emphasis. Rather, it is the unique combination of the vector amplitude and angle that determines which lookup address is used, and thus what degree of emphasis is allocated to the various output channels for each aperture period and frequency band.

The spectral address data that describes vector 84 requires only two numbers. For example, a polar coordinate system could be used in which one number describes the vector's polar angle and the other its direction. Alternately, an x,y grid coordinate system could be used. The vector concept is easily expandable to three dimensions, in which case a third number would be used for the elevation of the vector tip relative to its opposite end. Each different combination of vector amplitude and direction maps to a different address in the lookup table.

This spectral address representation is also important because it allows the input signal to be played back in various playback channel configurations by simply using different lookup tables for the SMCs for different speaker configurations. A separate 2-D or 3-D vector-to-SMC lookup table could be used to map for each different playback configuration. For example, four-speaker and six-speaker systems could be operated from the same compact disk or other audio medium, the only difference being that the four-speaker system would include a lookup table that translated the vector address data into four output channels, while the six-speaker system would include a lookup table that translated the address data into six output channels. The difference would be in the design of a single IC chip at the decoder end. In the 3-D audio case, having proper phase information in the stereo "carrier" signal is important. Other characteristics of the particular playback environment, such as the spectral response of particular speakers or environments, can also be accounted for in the "position"-to-SMC lookup tables.

The most direct way to implement the lookup table is to have each different lookup address provide the absolute values of the SMCs that relate each input channel to each output channel. Alternately, the active matrix approach of the present invention could be superimposed on a prior passive matrix approach, such as the Dolby or Rocktron techniques mentioned previously. For example, a fixed (passive) coefficient could be assigned to each input-output channel pair for each frequency band on a predetermined basis, which could be equal passive coefficients for each input-output pair. Respective active SMCs generated in accordance with the invention would then be added to the passive coefficients for the various input-output pairs.

The present invention may be used to make so-called compatible CDs, in which the CD contains a conventional stereo recording playable on conventional CD players. However, lower order bits, preferably only a fraction of the least significant bit (LSB) of the conventional digital sample words of the signal, are used to carry the SMCs for a multichannel playback. This is called a fractional LSB method of implementing the invention. ¼ of a LSB, for example, means that for every fourth signal sample the LSB is in fact an SMC data bit. At conventional stereo digital audio PCM sample rates of 48,000 samples per second this yields over 24,000 bits per second to define the SMCs (12,000 bits per second per stereo channel), while having an inaudible effect on the stereo audio signal. For a conventional 16 bit CD the audio resolution would be 15.75 bits per sample instead of 16 bits, but this is an inaudible difference. In some circumstances the other LSBs can be adjusted to spectrally shift any residual noise to hide it within a spectrally masking part of the audio spectrum; this kind of noise shaping is well known to those skilled in the art of digital signal processing. The fractional LSB method can be used to implement the invention on any digital audio medium, such as DAT (digital audio tape). A unique key code can be included in the fractional LSB data stream to identify the presence of the SMC data stream so that playback equipment incorporating the present invention would automatically respond.

Figure 8:
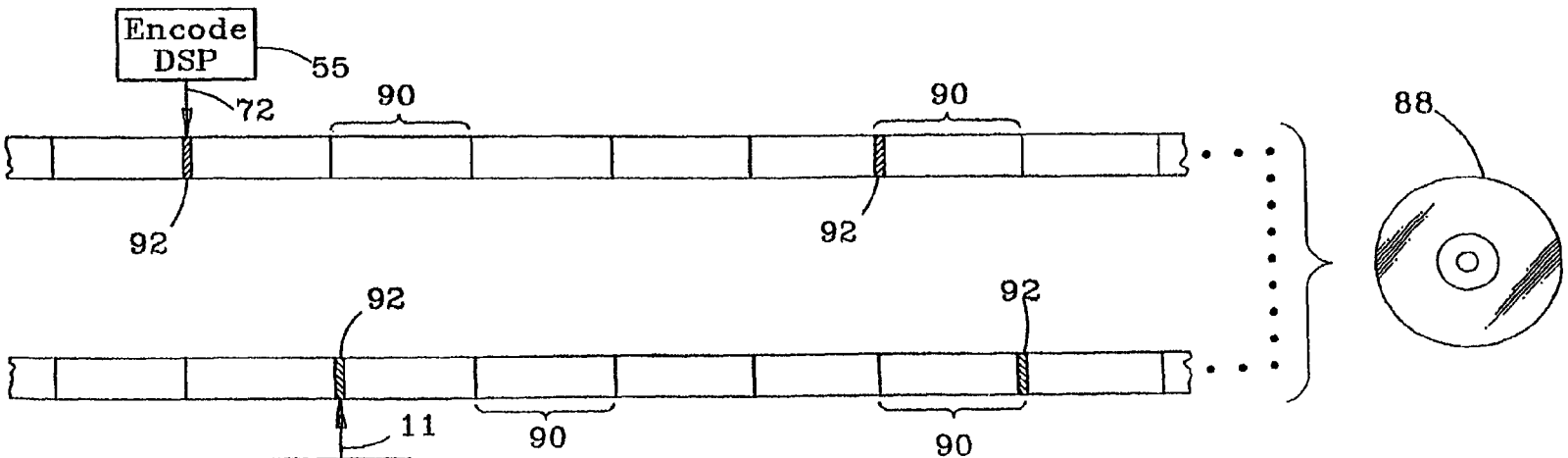
FIG. 8 is a diagram illustrating a fractional least significant bit method for encoding an audio signal with mapping coefficients.

The fractional LSB approach is illustrated in FIG. 8. Audio data from the encoder formatter 70 is transferred onto a digital audio medium, for example a compact disk 88, as multibit serial digital sample words 90, typically 16 bits per word at present. The encode DSP 55 encodes successive bits of the multibit SMCs onto the LSBs of selected sample words, preferably every fourth word, via output line 72. The sample word bits that are allocated to the SMCs are indicated by hatching and reference number 92. The SMC bits 92 are applied to the decode DSP 5 via its input 11.

The invention can also be used with an FM radio broadcast as the digital medium. In this case the SMC data is carried on a standard digital FM supplementary carrier. The FM audio signal is spectrally decomposed in the receiver and the invention implemented as described above. CDs made with the invention can be conveniently used as the source for such broadcasts, with the fractional LSB SMC data stream stripped from the CD and sent on the supplementary FM carrier with the stereo audio signal sent as the usual FM broadcast. The invention can be used in other applications such as VHS video, in which case the "carrier" stereo signal is recorded as the conventional analog or VHS HiFi audio signal and the SMC data stream is recorded in the vertical or horizontal blanking period. Alternatively, if the "carrier" audio can be recorded on the VHS HiFi channel, the SMC data stream can be encoded onto one of the conventional analog audio tracks.

In general the invention can be used with mono, stereo or multichannel audio inputs as the "carrier" signal or signals, and can map that audio onto any number of output channels. The invention can be viewed as a general purpose method for recasting an audio format in one channel configuration into another audio format with a different channel configuration. While the number of input channels will most commonly be different from the number of output channels, they could be equal as when an input two-channel stereo signal is reformatted into a two-channel binaural output signal suitable for headphones. The invention can also be used to convert an input monaural signal into an output stereo signal, or even vice versa if desired.

While several embodiments of the invention have been shown and described, numerous variations and alternate embodiments will occur to those skilled in the art. It is therefore intended that the invention be limited only in terms of the appended claims.

I claim:

1. An audio playback system, comprising:

a digital signal processor implemented on an integrated circuit (IC) chip, and the digital signal processor configured for performing operations for reproducing on a two channel target signal an audio signal present on a mono or two channel source signal, the operations comprising:

receiving the audio signal organized into successive temporal aperture periods in digital format on the mono or two channel source signal along with a set of spectral mapping coefficients for each of said aperture periods that vary among said aperture periods, and that, for each band of the mono or two channel source signal, map a signal level within that band onto desired signal levels for corresponding bands of the two channel target signal, where the spectral mapping coefficients are defined by an encoding process that is independent of the audio signal decoding process; and applying the spectral mapping coefficients to the audio signal on the mono or two channel source signal to obtain the audio signal on the two channel target signal, where the spectral mapping coefficients are grouped and controlled by a single spectral mapping coefficient;

a reformatter for reformatting the mono or two channel source signal into the two channel target signal; and a digital-to-analog (D/A) converter for converting the two channel target signal into a two channel analog audio output signal suitable for a speaker.

2. The method of claim 1, where the source and target signals represent audio channels and the number of source signals is different than the number of target signals.

3. The audio playback system of claim 1, where the audio signal is a monaural signal or a stereo signal.

4. The audio playback system of claim 1, where the signal level is an energy level or amplitude of the audio signal.

5. The audio playback system of claim 1, where the signal level and spectral mapping coefficients are received as a broadcast signal.

6. The audio playback system of claim 1, where the digital signal processor performs operations further comprising:

receiving the audio signal and spectral mapping coefficients from a digital medium.

7. The audio playback system of claim 1, where the digital signal processor performs operations further comprising:

matrix decoding the audio signal.

8. The audio playback system of claim 1, where the digital signal processor performs operations further comprising:

filtering the audio signal with a multiband digital filter.

* * * * *

UNITED STATES PATENT AND TRADEMARK OFFICE

CERTIFICATE OF CORRECTION

PATENT NO. : 7,864,965 B2
APPLICATION NO. : 11/745969
DATED : January 4, 2011
INVENTOR(S) : Terry D. Beard It is certified that error appears in the above-identified patent and that said Letters Patent is hereby corrected as shown below:

Column 10, lines 47-49 (Claim 2), please delete Claim 2 in its entirety.

Signed and Sealed this
Twentieth Day of March, 2012

David J. Kappos

David J. Kappos
*Director of the United States Patent and Trademark Office*